US005358544A

United States Patent [19]

Warner

[11] Patent Number: 5,358,544

[45] Date of Patent: Oct. 25, 1994

[54] METHOD OF RECOVERING ZINC

[75] Inventor: Noel A. Warner, Birmingham, United Kingdom

[73] Assignee: The University of Birmingham, England

[21] Appl. No.: 60,031

[22] Filed: May 10, 1993

[30] Foreign Application Priority Data

Mar. 18, 1993 [GB] United Kingdom ..... 9305560

[51] Int. Cl.[5] ..... C22B 4/00

[52] U.S. Cl. ..... 75/10.3; 75/655

[58] Field of Search ..... 75/655, 10.3

[56] References Cited

U.S. PATENT DOCUMENTS 4,334,918 6/1982 Warner ..... 75/655
4,741,770 5/1988 Andrews ..... 75/655
5,131,944 7/1992 Malmstrom ..... 75/655

FOREIGN PATENT DOCUMENTS 0266975 5/1988 European Pat. Off. ..... 75/655
2048309 12/1980 United Kingdom ..... 75/655

OTHER PUBLICATIONS

"Towards Polymetallic Sulfide Smelting", N. A. Warner, International Symposium on Complex Sulfides, TMS-AIME, San Diego, Calif., Nov. 10-13, 1985.

*Primary Examiner*—Peter D. Rosenberg
*Attorney, Agent, or Firm*—Andrus, Sceales, Starke & Sawall

[57] ABSTRACT

Zinc is recovered from zinc sulphide material by introducing such material at a feed station into a molten copper sulphide matte which is circulated in a closed loop path through said feed station, a zinc recovery station and an oxidizing station. The matte is heated electrically directly by resistive heating. Oxygen in the absence of other gases is introduced at the oxidizing station. Sulphur dioxide is removed in a sulphuric acid plant. The method is operated to keep the activity of copper in the total matte at less than unit activity. Virtually zero gas emission is possible.

11 Claims, 6 Drawing Sheets

METHOD OF RECOVERING ZINC

Figure 1:
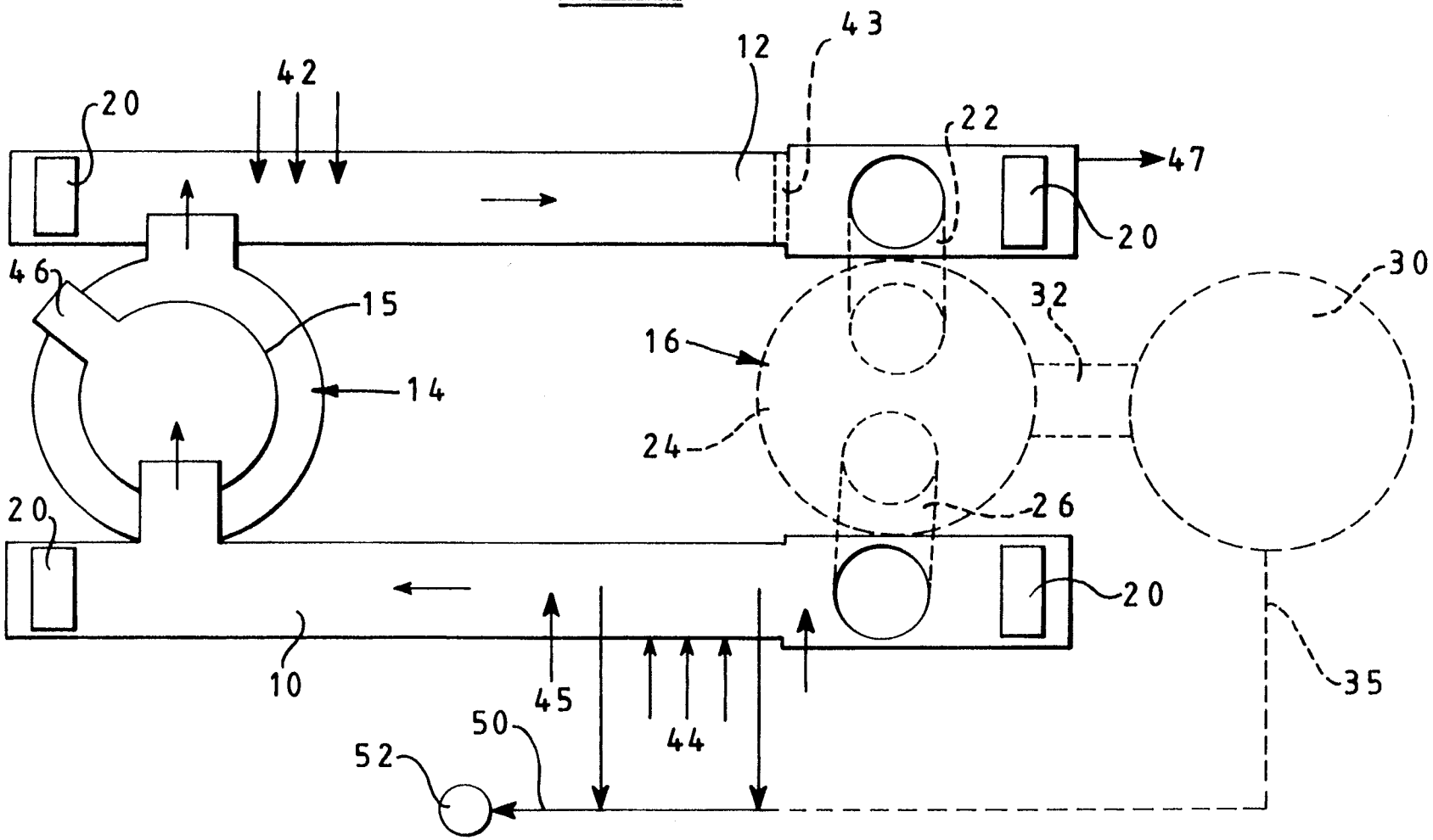

This invention relates to a method of recovering zinc from a zinc sulphide material, particularly a zinc sulphide ore concentrate.

More than 80 percent of the world's zinc is produced electrically by roasting zinc sulphide ore concentrates to yield zinc oxide calcine, which is subsequently leached in a sulphuric acid medium and subjected to electrolysis after extensive electrolyte purification giving a pure zinc cathode as product. The overall process is referred to the Roast Leach Electrowin (RLE) process or just simply the electrolytic zinc process (EZ). If the electricity used for EZ is thermally generated, then the total energy consumption is comparable to that of the well established thermal zinc technology (referred to as the Imperial Smelting Process (ISP).

The major drawback with the electrolytic process is related to the disposal of the iron residues, jarosite or goethite. Invariably these residues contain toxic metals in the form of soluble salts which, over a period of time, can leach out and contaminate ground water, giving rise to very serious environmental concern. In this respect, ISP holds an advantage over EZ since most of the residues produced are contained in a discard slag which, although containing heavy metals, these are in insoluble forms so that the slag can be stored outside without the risk of surface water contamination.

Both EZ and ISP begin with oxidation of the zinc sulphide minerals in air or at best in moderately oxygen enriched air, producing sulphur dioxide gas along with vast amounts of residual nitrogen. With modern technology, using for example double contact sulphuric acid manufacture, the effluent can be exhausted to the atmosphere with very low $SO_2$ or acid mist levels.

It has also been proposed in GB-A-2048309 to recover zinc from a zinc sulphide concentrate by circulating molten copper sulphide matte in a closed loop path serially through a feed station, an oxidising station and a zinc recovery station; heating the matte to maintain it in a molten state; introducing the zinc sulphide ore into the molten matte at the feed station; introducing oxygen into the matte at the oxidising station; and recovering zinc at the zinc recovery station. In such a process, the molten copper sulphide matte is maintained in a molten state by means of an oxy-fuel burner which is preferably located between the zinc recovery station and the oxidising station and which serves to heat the surface of the matte from which slag has been removed. The oxygen is blown on to the surface of the matte at the oxidising station so as to react with the copper sulphide in the matte to produce copper metal and sulphur dioxide. The sulphur dioxide is removed and passed together with other gaseous products and unconsumed gaseous reactants to an acid plant for recovery of sulphuric acid. Molten copper is passed from the oxidising station to the zinc recovery station in an amount which exceeds the stoichiometric quantity of metallic copper required for extracting the zinc. Within the zinc recovery station, the metallic copper reacts with the zinc sulphide to produce metallic zinc and copper sulphide. Under the conditions prevailing in the zinc recovery station, the metallic zinc is volatile and is withdrawn by a vacuum pump for collection in a suitable external condenser.

Such a process inherently generates large quantities of gases which require to be effectively scrubbed of sulphur dioxide in the sulphuric acid plant.

The present inventor has disclosed in "Simultaneous Recovery of Zinc, Copper and Lead as Metals from Complex Sulphides in a Single Polymetallic Smelting Furnace" (Summary Reports of the R&D Programme Primary Raw Materials (1986–1989) volume III: Mineral Processing, Commission of the European Communities published May 13, 1992) that an experimental pilot plant based on the process of GB-A-2048309 was built at the University of Birmingham to investigate the feasibility of extracting zinc, copper and lead pyrometallurgically without recourse to complicated separation procedures at the ore dressing stage, and that such experimental pilot plant used direct electrical resistance heating of the matte in order to melt it and keep it molten. However, it was made clear that fossil fuel heating would be used commercially, and it was also made clear that the matte is saturated with copper.

EP-A 0266975 discloses the importance of maintaining a protective layer of molten material such as lead below the circulating matte in order to prevent erosion of the refractory hearth floor. The importance of maintaining a pool of molten copper on the refractory hearth floor to prevent erosion is also emphasised in "Towards Polymetallic Sulfide Smelting" by the present inventor, International Symposium on Complex Sulfides. TMS-AIME, San Diego, U.S.A., Nov. 10–13, 1985.

It is an object of the present invention to provide an improved method of recovering zinc from a zinc sulphide material.

According to the present invention, there is provided a method of recovering zinc from a zinc sulphide material comprising the steps of circulating molten copper sulphide matte in a closed loop path serially through a feed station, a zinc recovery station and an oxidising station; heating the matte to maintain it in a molten state; introducing zinc sulphide material into the molten matte at the feed station; contacting the surface of the matte with oxygen (preferably by blowing oxygen onto the surface of the matte) at the oxidising station; and recovering zinc at the zinc recovery station; characterised in that the circulating matte is heated resistively during zinc recovery by passing an electric current directly therethrough over at least part of the closed loop path, and in that the oxygen contacting step is controlled so as to prevent copper metal saturation of the matte in the main matte circuit and thereby prevent separation of a layer of copper at least over that part of the closed loop path which is being resistively heated.

To recover precious metals, it may be advantageous for copper to be produced in a small "cul-de-sac" interconnected with but not part of the main matte circuit.

In such a method, electrical resistance heating of the matte by passing an electric current directly therethrough results in the production of much smaller quantities of gases than the prior art process of GB-A-2048309 involving the use of an oxy-fuel burner to heat the matte. Additionally, exothermic heat generated as a result of the reaction of oxygen with the sulphide to produce sulphur dioxide and to form iron-containing slag is also used effectively to heat the matte directly so that energy consumption can be reduced. The input of electrical energy to the matte circulation merely supplements that already inherently available and, for a full size commercial plant, it can be shown that around 1600 KwH electrical input is required to produce one tonne of zinc from a typical high grade zinc concentrate, whereas current electrolytic plants consume around 4600 KwH per tonne of zinc, thereby providing a very considerable electrical energy advantage.

In the method of the present invention, it is essential to avoid a pool of molten copper or other electrically conductive material in the bottom of the hearth because this can result in short-circuiting which is potentially dangerous and which leads to inadequate heating of the matte itself and excessive power consumption. In the method of the present invention, the activity of copper in the total matte is less than unity. Whilst it is important to prevent an overall generation of metallic copper to an extent which results in saturation and the formation of a pool of copper below those regions of the matte through which heating current is actually being passed, it is possible to permit localised generation of metallic copper above saturation within the oxidising station provided that a pool of copper which is capable of short-circuiting the electrical heating current is not thereby formed. Indeed, it may be advantageous in one part of the circuit positively to arrange for production of elemental copper in order to assist in the recovery of other metal valuables such as silver and/or gold which may be present in the zinc sulphide material. However, in such an event, precautions are taken to prevent the molten copper from migrating to the principal region of the closed loop path which is being electrical resistance heated. For example, such precautions may take the form of partitions in the hearth which physically prevent passage of the molten pool of copper which collects under the specified region of matte into the electrically heated region(s) of the matte.

In order to limit unacceptably high electrical energy losses by current flowing through extraneous circuits rather than the matte itself in the method of the present invention, it is preferred to utilise a hearth formed of a shell comprising a multiplicity of mutually electrically insulated metal (e.g. steel) plates which are lined by a relatively thin (e.g. 10 cm thick) brick or cast refractory lining and to effect forced cooling of the steel plates externally so as to keep the freeze line of the matte within the refractory material as close as possible to the hot face of the refractory in contact with the melt. In this way, matte which has penetrated into the brickwork or cast refractory lining is frozen and thereby reduces penetration of matte throughout the whole of the lining. The use of mutually electrically insulated metal plates for the hearth prevents electrical short circuiting to a catastrophic extent in the event that molten conductive matte and or copper reaches the metal shell of the hearth.

In a preferred embodiment, the closed loop path is established between upper and lower hearths with a weir from the upper to the lower hearth, and a pump such as a vacuum lift unit having a vacuum chamber with an inlet leg in the lower hearth and an outlet leg discharging into the upper hearth. In such an arrangement, the vacuum lift unit serves to remove zinc vapour and defines the zinc recovery station.

Most preferably, electrical heating of the matte is effected so as to keep the matte molten and to provide at least 30% of the energy requirements for zinc smelting. Preferably, the matte is subjected to electrical resistance heating by means of electrodes disposed at opposite ends of at least one of the hearths, preferably the lower hearth.

Because substantial expansion and contraction of the hearths can take place during heating, particularly in a design where each hearth is defined by a metal shell lined with a relatively thin refractory layer, it is preferred for the electrodes to comprise graphite or other suitably inert conductive rods or blocks whose upper surfaces have recesses therein in which molten metal, e.g., lead, is contained and for the electrical supply to the electrodes to be effected through terminals, e.g., copper terminals, which are immersed in such molten metal. With such an arrangement, the electrodes can be firmly secured to the respective hearth at opposite ends thereof and can therefore move longitudinally with expansion and contraction of the hearth in which they are fitted.

It is particularly preferred for oxygen to be introduced into the oxidising station in the form of oxygen (e.g. technically pure oxygen, typically 95% pure) rather than in the form of air or oxygen-enriched air. If oxygen is used, then the method of the present invention generates essentially only sulphur dioxide as the main gaseous product and this can be effectively separated from excess oxygen in a sulphuric acid plant in the absence of large quantities of other gases (e.g. nitrogen), the excess oxygen being recycled back to the oxidising station, thereby leading to a zinc smelting process which is substantially free of any gaseous discharge. No other virtually zero gas emission zinc smelting process exists for treating high grade zinc concentrates.

In the St. Joseph electrothermic process, the charge used consists primarily of zinc oxide sinter and coke, which is pre-heated to 750° C. before being charged to the top of the furnace. In such process, heat is generated by the resistance of the solid charge to current flow in the furnace. This resistance heating takes place between sets of graphite electrodes inserted through the top and bottom furnace walls. Like all blast furnace processes, high grade metallurgical coke is a pre-requisite and the process does not have the energy advantage of direct sulphide to metal smelting as in the method of the present invention. The energy costs and capital costs per unit of zinc produced are high, and consequently the role of this process for zinc production is diminishing.

The zinc sulphide material which can be used in the method of the present invention can be any zinc sulphide ore concentrate where zinc is the predominant metal valuable present.

Figure 2:
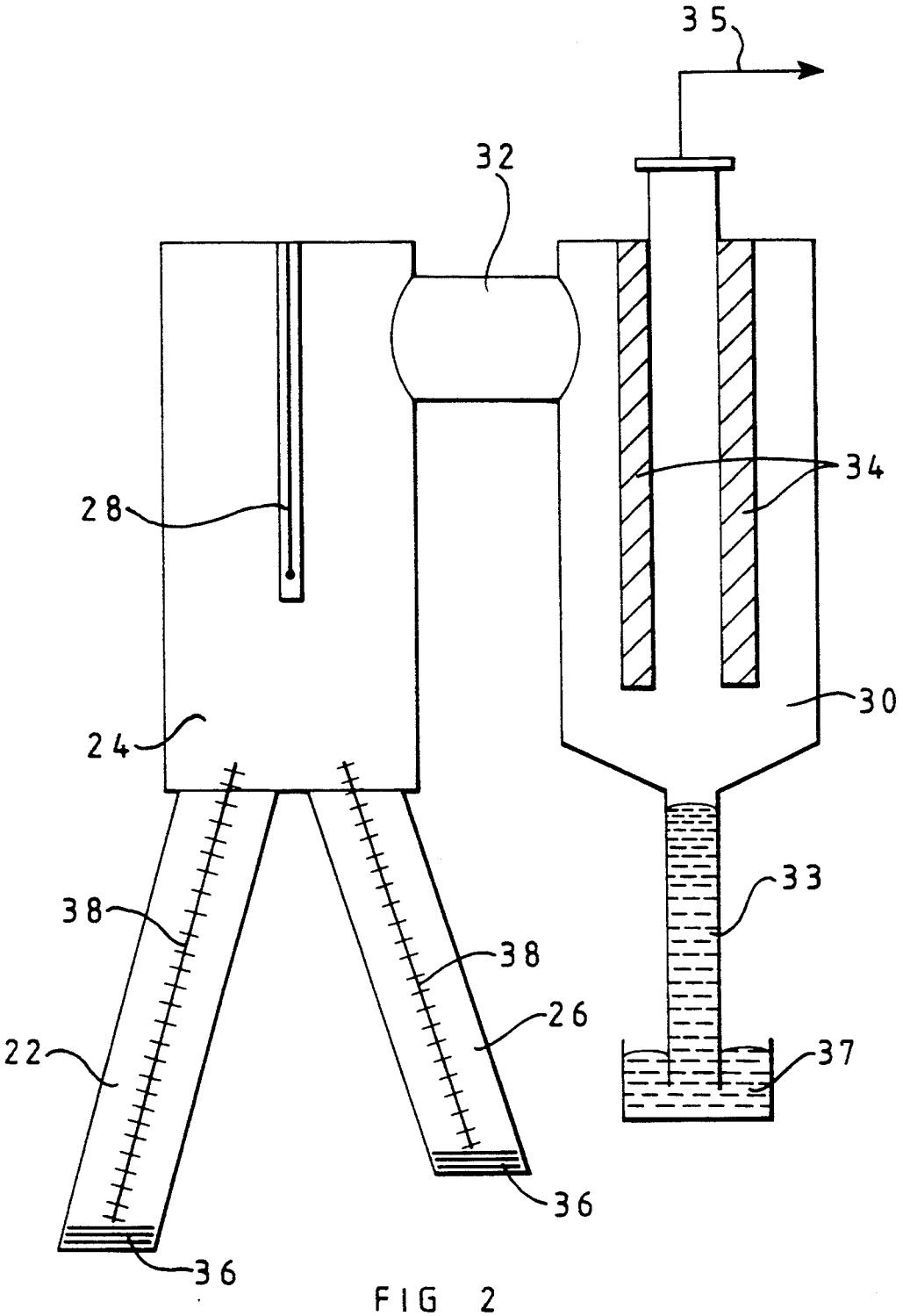
Figure 3:
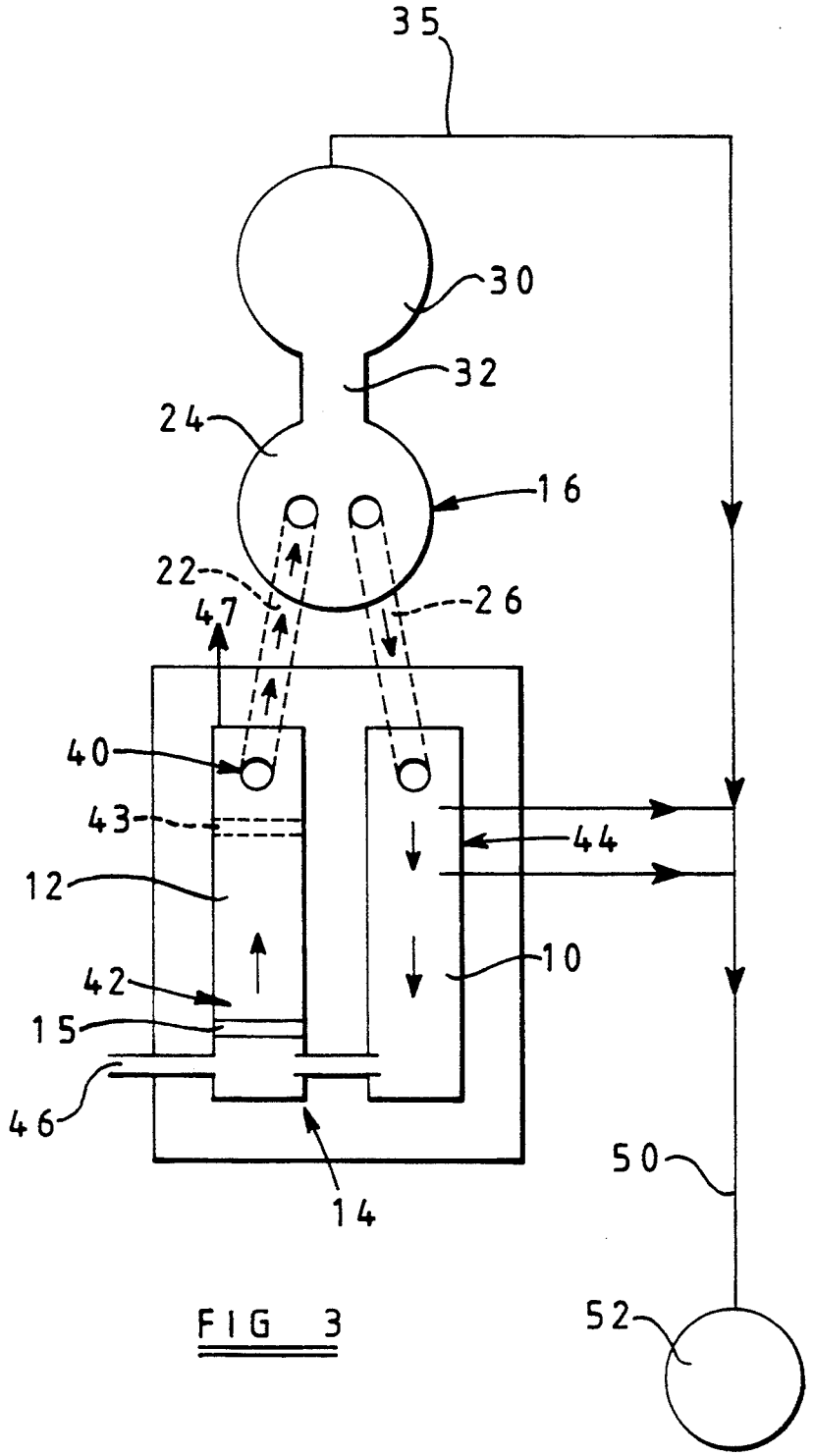
Figure 4:
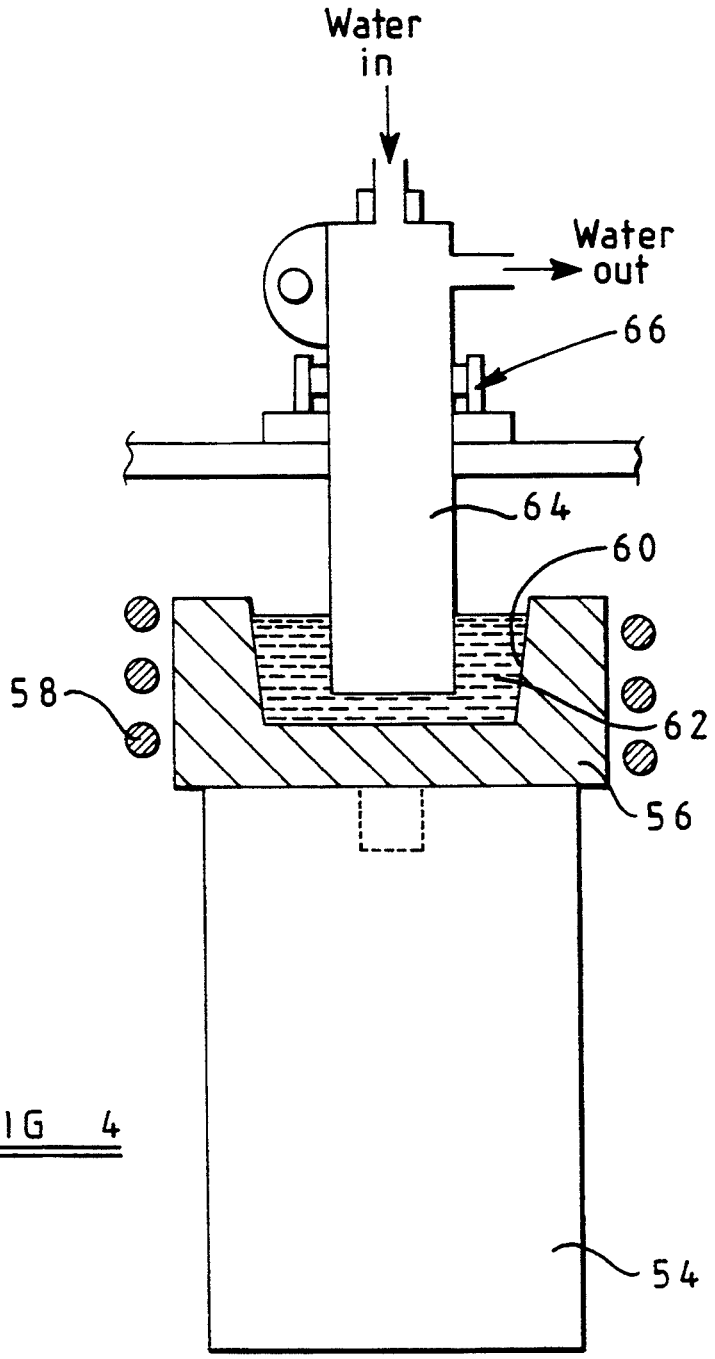
Figure 5:
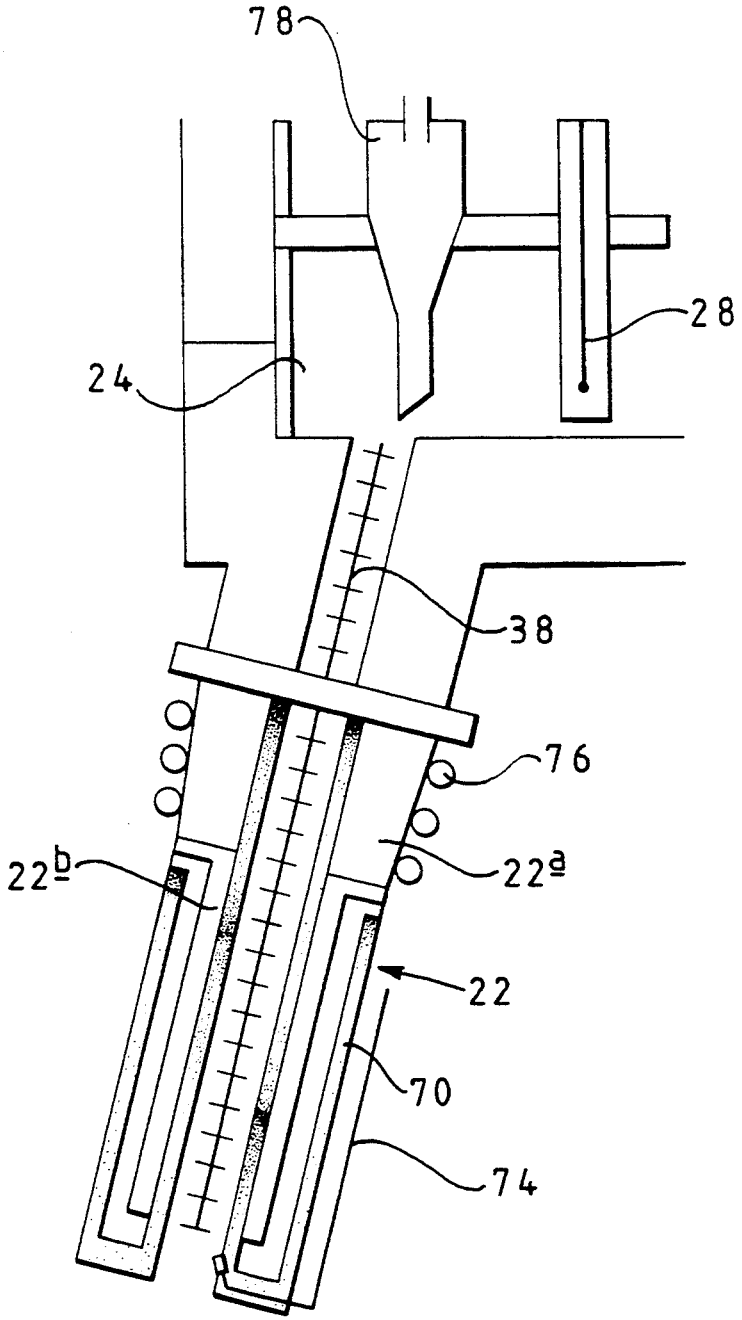
Figure 6:
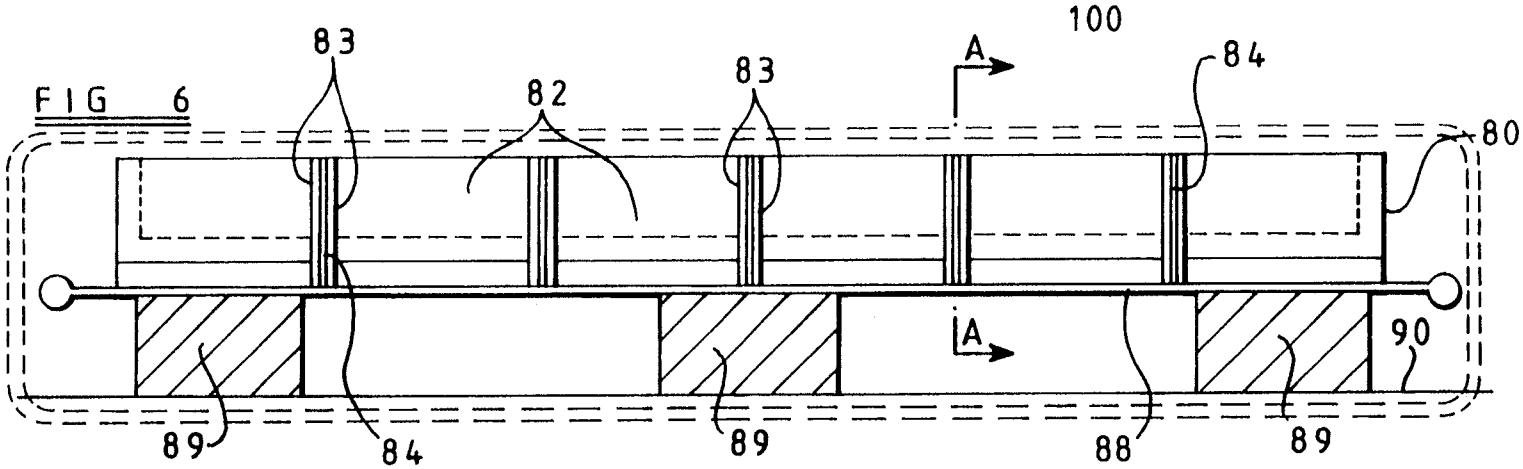
Figure 7:
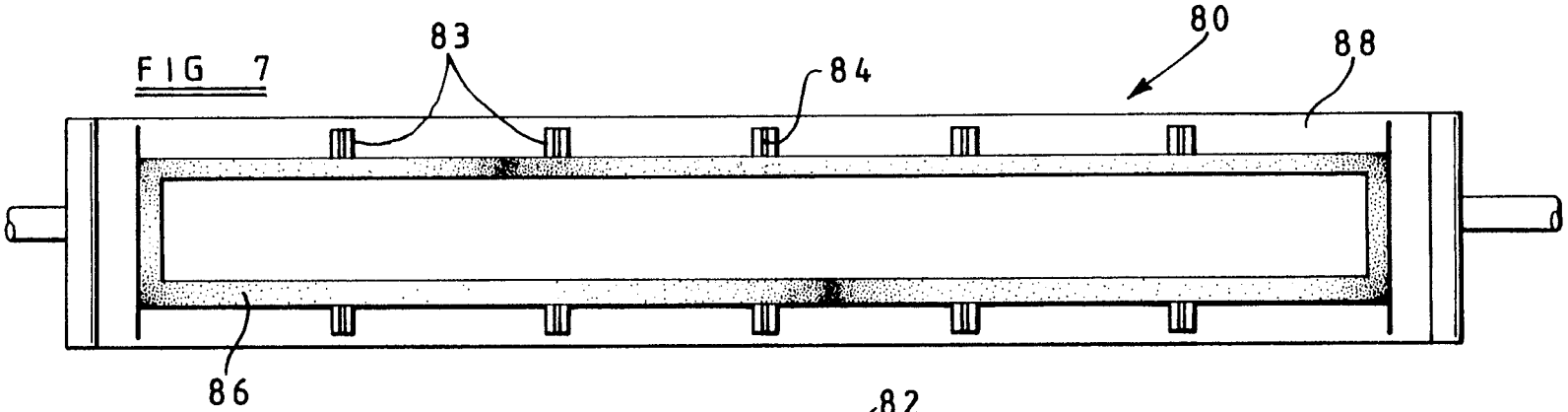
Figure 8:
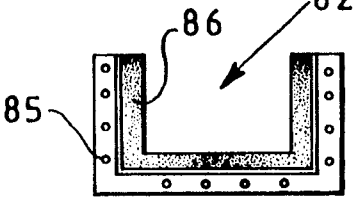

An embodiment of the present invention will now be described, by way of example, with reference to the accompanying drawings, in which:

FIG. 1 is a schematic plan view of a smelter in which the method of the present invention can be performed, FIG. 2 is a de-gassing unit and condenser for removal and condensation of zinc vapour, FIG. 3 is a schematic plan view of a slightly modified form of the smelter of FIG. 1, FIG. 4 is a schematic elevation of a typical electrode used in the smelter of FIG. 1, FIG. 5 is a detailed view of a typical snorkel leg assembly of the de-gassing unit, FIG. 6 is a side view showing the hearth construction of the smelter, FIG. 7 is a plan view of the hearth construction of FIG. 6, and FIG. 8 is a section on the line A—A of FIG. 6.

Referring now to FIG. 1 of the drawings, the smelter comprises a relatively shallow upper hearth 10, a similarly relatively shallow lower hearth 12, a combined matte cross-over weir and slag separating unit 14 interconnecting the upper and lower hearths at one end of the smelter, and a vacuum de-gassing unit 16 interconnecting the upper and lower hearths 10 and 12 at one end of the smelter for establishing a closed loop circulation path for molten copper sulphide matte and for recovering of zinc. At each end of each of the upper and lower hearths 10 and 12, there is provided a respective graphite electrode assembly 20 whose construction and function will be described hereinafter.

The vacuum-degassing unit 16 has an inlet snorkel leg 22 leading from the lower hearth 12 to a vacuum chamber 24, and an outlet snorkel leg 26 leading from the vacuum chamber 24 to the upper hearth 10. The vacuum chamber 24 is defined by an RH vessel (see FIG. 2) having a main electrical heater 28 therein. The upper part of the vacuum chamber 24 leads to a condenser 30 via a crossover passage 32. The condenser 30 contains liquid lead-cooled condenser surfaces 34 which are maintained, in use, at a temperature greater than the solidification temperature of zinc. The upper part of condenser 30 is connected via a line 35 to a vacuum pump and filters (not shown) to maintain the required reduced pressure therein and in the vacuum chamber 24. Liquid zinc condensate is removed continuously via a barometric leg seal 33 into a bath 37 of molten zinc which is either tapped intermittently or continually overflown to yield the zinc product.

Each of the inlet and outlet legs 22 and 26 may be fitted with a respective electrical tip heater 36 and a respective electrical leg heater 38. The inlet leg 22 is arranged to be sparged with nitrogen gas via line 40 to reduce the density of matte in the leg 22 and thereby permit it to be drawn into the vacuum chamber 24.

Zinc ore concentrate, possibly pelletised but not necessarily pre-treated in any way other than being dried, is fed into the matte at a feed station indicated by arrows 42 downstream of the unit 14 into the lower hearth 12 which constitutes a reducing side of the smelter. The matte in the hearth 12 overflows weir 43 and then passes into the unit 16 where zinc is removed as described above. From the unit 16, the zinc sulphide-depleted matte passes into the upper hearth 10 which constitutes an oxidising side of the smelter in that an oxidising station 44 (where oxygen is blown onto the surface of the matte) is provided intermediate the ends of the hearth 10, but preferably closer to the outlet snorkel leg 26 so that the slag formed can be cleaned in-situ by addition of pyrite via line 45 as it floats away on the circulating matte.

In FIG. 1, the slag is separated from the matte for disposal via outlet 46 in the unit 14 which is mounted between the hearths 10 and 12 quite independently of the upper and lower hearths 10 and 12. Matte and slag overflow continuously from the hearth 10 into a forward region of the unit 14, with matte then passing under an underflow weir 15 and slag accumulating above the weir 15 so that it is retained long enough for entrained matte droplets to settle out before overflowing via outlet 46 into a slag disposal system (not shown). The slag-free matte then overflows into the lower hearth 12 and begins its passage along this hearth 12 to the overflow weir 43.

In the modified arrangement of FIG. 3 (where similar parts to those of FIG. 1 are accorded the same reference numerals), the unit 14 has its cross-over weir and slag removal functions physically separated in that the matte together with the slag crosses over from hearth 10 into an upstream region of hearth 12 which communicates with the remainder of the hearth 12 by underflow weir 15 for matte. The slag is removed via outlet 46 which is disposed on the opposite side of the hearth 12 to the cross-over from the hearth 10 in order to give the matte and the slag crossing over from the hearth 10 time to separate.

Means 47 are provided downstream of weir 43 for removal of fused gangue slag or solid residues.

The smelter is vented via line 50 to a sulphuric acid plant 52 for removal of sulphur dioxide and water vapour, whilst excess oxygen is recycled back to the oxidising station 44.

Referring now to FIG. 4, each electrode assembly 20 comprises a graphite electrode 54 which is immersed in the matte in the respective hearth 10, 12. The graphite electrode 54 includes an upper head region 56 which is disposed above the level of the matte and which may be furnished with an electrical heating element 58 and a recess 60 containing lead 62 maintained in a liquid state by means of the heating element 58. A water-cooled terminal 64 adjustable in height by means of a clamp and height adjustment assembly 66 is immersed in the molten lead 62 to provide an effective electrical connection between an electrical supply busbar (not shown) and the graphite electrode 54. The graphite electrode 54 is clamped by an electrically insulating clamp assembly (not shown) to the respective hearth 10 or 12. Thus, the electrode 54 moves relative to the terminal 64 upon expansion and contraction of the hearth. This movement of the graphite electrode 54 is accommodated for by the above-described arrangement of terminal 64 which dips into the molten lead 62 in the recess 60.

Referring now to FIG. 5, the inlet leg 22 of the vacuum-degassing unit 16 is shown in greater detail. The upper part **22*a* of the leg 22 is formed integrally with the lower part of the vacuum chamber 24 out of an RH hearth refractory material. The lower part 22*b* of the leg 22 is fitted with a nitrogen-cooled jacket 70, and a stainless steel sparger 74 for introducing gaseous nitrogen into the leg 22 from line 40**.

The upper part **22*a* of the inlet leg 22 is fitted with a water-cooled jacket 76. The upper part of vacuum chamber 24 has a ceramic fibre wall between the steel casing and a refractory cylindrical liner and is fitted with graphite cyclones 78 (only one shown) in addition to the electrical heating element 28 described previously. The cyclones 78 serve to return entrained matte droplets to the molten stream rather than allowing them to be carried over in the gas/vapour stream to the condenser 30**.

Referring now to FIGS. 6 to 8, the upper and lower hearths 10 and 12 are each formed of a shell 80 defined by a multiplicity of preformed heat-resisting steel plate trough sections 82 having flanges 83 which are separated by electrically insulating spacers 84 through which pass fixing bolts which are fitted with insulating collars 85 to isolate the bolts electrically from the trough sections 82. The shell 80 is lined internally with a relatively thin (e.g. 10 cm thick) brick or cast refractory lining 86. The upper and lower hearths (see FIG. 1) formed from the trough sections 82 are themselves located within a larger steel furnace enclosure 100 which is force-cooled by fan driven air circulation on its outer surfaces. The upper hearth and the lower hearth trough assemblies are mechanically completely independent of each other so that they are free to expand and contract independently. The outer steel surfaces lose heat by radiation and natural convection to internal surfaces of the overall furnace enclosure. The basal areas lose heat to a fabricated steel base 88 of double wall construction with high velocity cooling air flowing through the small clearance between these walls. The base 88 itself stands on brick plinths 89 above a brick-lined safety lining 90 on the floor of the furnace enclosure. By these means, the outer surfaces of the trough sections 82 reach a steady state temperature typically in the range 400° to 650° C. so it is absolutely imperative that they are free to expand in all directions. The consequence of the high heat flux which can be sustained at the outer surfaces at these relatively high surface temperatures is that the temperature gradient through the refractory lining 86 is relatively steep and therefore the melt freeze line is located close in towards the high temperature face of the lining. This materially assists in the prevention of matte penetrating the lining 86 and making electrical contact with the steel shell. In the event of some contact being made, however, the whole furnace circuit is not short-circuited because of the isolation electrically of the multiplicity of trough sections 82 involved in the electrical circuit.

It is important to ensure that the overflows leading from the hearth 10 into the unit 14 and from the unit 14 into the hearth 12 are mechanically independent so that free expansion and movement can occur without creating stress on the refractories.

Provision has to be made to restrict oxidising gases to the intermediate top blow region using devices such as nitrogen curtains and local gas exhaust leading to line 50 immediately upstream and downstream of the top blow area at oxidising station 44. This means that the gas atmosphere in the remaining enclosed volume of the furnace is either slightly reducing or neutral and does not pose a serious threat to the integrity of the graphite electrodes 20 used to supply the electrical energy requirements for smelting.

In the lower hearth 12, the matte surface is maintained relatively free of slag or solid gangue residues so that the zinc ore concentrates are readily assimilated into the circulating melt by the provision of the overflow weir 43 over which matte and any associated slag or residues floating on top thereof pass just upstream of the vacuum degassing unit inlet leg 22. The accumulated slag or residue downstream of the weir 43 is periodically or continuously removed via line 47. The matte itself is withdrawn by the inlet leg 22 of the unit 16.

In use, a protective nitrogen gas blanket is provided for the hearths 10 and 12 and vacuum chamber 24. The copper sulphide matte within the hearths 10 and 12 and within the unit 14 is melted and maintained in a molten condition by electrical heating. In the case of the matte within the hearths 10 and 12, electrical heating is direct electrical resistance heating of the matte by passage of a current therethrough via the previously described electrode assemblies 20 to a temperature of about 1270° C. which is about 150° C. above the liquidus temperature of about 1120° C. to ensure fluidity of the melt. Circulation of the matte is effected by means of the vacuum de-gassing unit 16 which operates as described previously. The molten matte is free to flow from the upper hearth 10 to the lower hearth 12 under the action of gravity via the unit 14. In this way, a circulation of the matte is maintained at a relatively high rate.

An additional electrode assembly (not shown) may be provided in the hearth 12 to enable supplementary heating of the matte at the centre of the hearth 12.

Whilst the molten matte is circulated in the above-described manner, technically pure oxygen is blown onto the matte in the upper hearth 10 at the oxidising station 44 in order to oxidise the copper sulphide matte to copper. Whilst local saturation with copper of the surface of the melt is achieved and a small amount of copper metal separates out and falls to the area immediately beneath the top blow oxygen lances, the bulk stream of flowing matte remains below copper saturation and the thermodynamic activity of copper in the bulk matte is less than unity as a result of the chemical reactions taking place in the vacuum degassing unit 16 in which dissolved copper is effectively stripped from the matte by reaction with dissolved zinc sulphide under very intensive conditions. Thus, by careful adjustment of the amount of oxygen supplied to the top blow region, the amount of liquid copper actually produced can be limited whilst not interfering with the overall zinc production in the vacuum degassing unit. The total oxygen consumed at the gas melt interface is rate controlled by gaseous diffusion. By suitable design of the top blowing region in terms of number of lances and their blowing intensity, the total amount of oxygen absorbed into the melt is under the control of the process operator. Once absorbed into the surface of the melt, the oxygen is consumed either by iron sulphide oxidation to produce an iron-containing slag, by oxidation of zinc sulphide which diffuses to the surface or by the conversion reactions involved in oxidising cuprous sulphide to copper. If a vast excess of oxygen is supplied, then clearly a large amount of copper would be produced, much of which would settle out as liquid copper. On the other hand if the supply of oxygen is restricted to just slightly more than the stoichiometric amount required to satisfy the iron sulphide slagging reaction and the overall zinc producing reaction $ZnS+O_2 \rightarrow Zn+SO_2$, then the amount of liquid copper which separates out to form a pool on the base of the hearth will itself be very limited. The actual steady-state thermodynamic activity of copper in various parts of the melt circulation circuit is then determined principally by a complex interaction of the various rate processes taking place and the melt circulation rate.

Oxidation of the copper sulphide matte is an exothermic process and the exothermic heat thereby produced serves to augment the electrical resistance heating of the matte. Such heat us transferred as a result of circulation of the molten matte to the feed station 42 at which zinc sulphide ore concentrate is added to the matte under any slag layer thereon and is melted in the matte. Thus, it will be appreciated that the material drawn through the inlet leg 22 of the vacuum de-gassing unit 16 also contains dissolved zinc sulphide, dissolved copper and a small amount of dissolved oxygen. When this mixture enters the vacuum chamber 24, chemical reactions take place resulting in zinc vapour and a relatively small amount of sulphur dioxide being removed via cross over passage 32. The zinc vapour is condensed on the condenser surfaces 34, whilst the sulphur dioxide is removed via line 35 to join the principal sulphur dioxide gas stream in line 50 derived from the oxygen top blowing of the matte in the upper hearth 10. The minor amounts of nitrogen which have been introduced via line 40 to promote passage of the molten material into the vacuum chamber 24 and the nitrogen picked up from the nitrogen protective blanket for the hearths are bled off from the excess oxygen stream exhausted from the sulphuric acid plant 52 and recycled to the top blowing region 44. This bleed stream containing oxygen and nitrogen is either returned to the air separation plant to oxygen enrich the air feed or is alternatively discharged to the atmosphere. The matte is then passed to the upper hearth 10 via the outlet leg 26 for recirculation through oxidising station 44. In passing through the vacuum degassing unit 16, there is some depletion in the concentration levels of dissolved zinc sulphide and oxygen in the matte, but it is to be appreciated that, in a closed loop with a large excess of matte circulating compared to the zinc production rate, these concentration changes are relatively minor. Under constant feed conditions, steady state concentration levels are attained in various regions throughout the loop as a result of the individual rate processes taking place.

Further details of the precise techniques used in the pilot plant can be obtained from the above-mentioned publication "Summary Reports of the R & D Programme Primary Raw Materials(1986 to 1989) Volume III: Mineral Processing", the disclosure of which is incorporated herein by reference.

I claim:

1. A method of recovering zinc from a zinc sulphide material comprising the steps of circulating molten copper sulphide matte in a closed loop path serially through a feed station, a zinc recovery station and an oxidising station; heating the matte to maintain it in a molten state; introducing zinc sulphide material into the molten matte at the feed station; contacting the surface of the matte with oxygen at the oxidising station; and recovering zinc at the zinc recovery station; wherein (a) the circulating matte is heated resistively during zinc recovery by passing an electric current directly therethrough over at least part of the closed loop path, and wherein (b) the oxygen contacting step is controlled so as to prevent copper metal saturation of the matte in the main matte circuit and thereby prevent separation of a layer of copper at least over that part of the closed loop path which is being resistively heated.

2. The method according to claim 1, wherein the surface of the matte is contacted with oxygen by blowing oxygen onto the surface of the matte.

3. The method according to claim 1, wherein the matte is circulated through at least one hearth formed of a shell comprising a multiplicity of mutually electrically insulated metal plates which are lined by a brick or cast refractory material and wherein forced cooling of the metal plates is effected externally so as to keep the freeze line of the matte within the refractory material.

4. The method according to claim 3, wherein the matte is circulated through a pair of hearths, each hearth being formed of a multiplicity of mutually electrically insulated metal plates are provided, the hearths being mechanically separated from each other so as to allow them to expand and contract independently.

5. The method according to claim 4, wherein the hearths are force cooled and are contained in a furnace enclosure which itself is force cooled.

6. The method according to claim 1, wherein the closed loop path is established between upper and lower hearths with a weir from the upper to the lower hearth, and a pump in the form of a vacuum lift unit having a vacuum chamber with an inlet leg in the lower hearth and an outlet leg discharging into the upper hearth, the vacuum lift unit serving to remove zinc vapour and defining the zinc recovery station.

7. The method according to claim 1, wherein electrical heating of the matte is such as to provide at least 30% of the energy requirement for zinc smelting.

8. The method according to claim 4, wherein said heating of the matte is by electrical resistance heating by means of electrodes disposed at opposite ends of at least one of said hearths.

9. The method according to claim 1, wherein the oxygen used in the contacting step is essentially the only gas introduced at the contacting station whereby essentially only sulphur dioxide is generated as the main gaseous product.

10. The method according to claim 9, including the steps of removing excess oxygen and the sulphur dioxide, separating the sulphur dioxide from the excess oxygen by converting the sulphur dioxide to sulphuric acid, and recycling the excess oxygen back to the oxidising station.

11. The method according to claim 3, wherein the resistive heating of the matte is effected using electrodes which extend into the matte and which are fixed relative to the metal plates, and wherein respective electrical supply terminals for the electrodes extend into molten metal in recesses in the electrodes whereby to permit movement of the electrodes resulting from expansion and contraction of the metal plates whilst continuing to maintain the electrical connection between each terminal and the respective electrode.

* * * * *